US007237394B2

(12) United States Patent
Rigal et al.

(10) Patent No.: US 7,237,394 B2
(45) Date of Patent: Jul. 3, 2007

(54) CHARGE MANAGEMENT FOR 100% HEAT RECOVERY UNITS

(75) Inventors: Philippe Rigal, Sevigneux (FR); Ba-Tung Pham, Chassieu (FR); Pierre Delpech, Fleurieu sur Saone (FR)

(73) Assignee: Carrier Corporation, Farmington, CT (US)

( * ) Notice: Subject to any disclaimer, the term of this patent is extended or adjusted under 35 U.S.C. 154(b) by 450 days.

(21) Appl. No.: 10/957,181

(22) Filed: Sep. 30, 2004

(65) Prior Publication Data

US 2006/0064995 A1 Mar. 30, 2006

(51) Int. Cl.
*F25B 45/00* (2006.01)

(52) U.S. Cl. ..... 62/149; 62/189

(58) Field of Classification Search ..... 62/77, 62/158, 181, 189, 149, 292
See application file for complete search history.

(56) References Cited

U.S. PATENT DOCUMENTS 4,637,219 A * 1/1987 Grose ..... 62/199
5,479,788 A * 1/1996 Roegner ..... 62/292
5,497,629 A * 3/1996 Rafalovich et al. ..... 62/98
5,806,328 A * 9/1998 Muston et al. ..... 62/149

* cited by examiner

*Primary Examiner*—Melvin Jones
(74) *Attorney, Agent, or Firm*—Bachman & LaPointe, P.C.

(57) ABSTRACT

An apparatus for managing refrigerant charge in an air conditioning unit comprising a cooling circuit through which a refrigerant flows from a compressor, through a condenser, and through an evaporator, a heat recovery circuit extending from a first terminus between the compressor and the condenser to a second terminus between the evaporator and the condenser, a heat recovery unit located between the first and second terminus of the heat recovery circuit, a first valve located between the condenser and the first terminus, a second valve located between the first terminus and the heat recovery unit, a third valve located on a cooling charge circuit having a first end on the cooling circuit between the condenser and the evaporator and a second end at the evaporator, a fourth valve located on a heating charge circuit having a first end on the heat recovery circuit and a second end at the evaporator, and a logic unit for sensing a saturated temperature and opening and closing the valves based upon the saturated temperature to manage the refrigerant charge.

12 Claims, 1 Drawing Sheet

CHARGE MANAGEMENT FOR 100% HEAT RECOVERY UNITS

BACKGROUND OF THE INVENTION (1) Field of the Invention

The invention relates to an apparatus, and method for using such an apparatus, for managing coolant charge in air conditioning systems operating with a heat recovery mode.

(2) Description of the Related Art

In a typical air conditioning system, refrigerant flows from a compressor through condenser coils, and through an evaporator before returning to the compressor or compressors. The circuit thus formed, is referred to herein as a cooling circuit. Refrigerant travels around the cooling circuit when the air conditioning unit is in a cooling mode. By "cooling mode" it is meant that refrigerant is circulated through a cooling circuit to cool the air around the coils of the evaporator. Often times, there is provided a heat recovery circuit in parallel with the cooling circuit. The heat recovery circuit makes use of a heat recovery unit. The heat recovery unit is formed of a series of coils surrounded by water. When heated refrigerant travels through the coils, heat is transferred, or recovered, by the transference of the heat from the refrigerant to the surrounding water. Refrigerant travels through the heat recovery circuit during heat recovery mode. Typically, a valve or valves are closed to prohibit refrigerant from traveling through the heat recovery circuit during cooling mode. Conversely, a valve or valves are closed to prohibit the travel of refrigerant through the cooling circuit during heat recovery mode.

Because of the differing demands placed on the air conditioning system during cooling mode and heating mode, there exists a need for differing amounts of refrigerant circulating in the system. Specifically, during cooling mode, there is a need for a greater amount of refrigerant to travel through the cooling circuit. Conversely, during the heating mode, there is a lesser requirement for refrigerant traveling through the heat recovery circuit. What is therefore needed is a method of controlling the differing amounts of refrigerant required in the cooling mode and in the heat recovery mode that does not detract from the operation of the system, but rather uses the energy stored in the unneeded refrigerant to optimize the operation of the system in either mode.

SUMMARY OF THE INVENTION

Accordingly, it is an object of the present invention to provide an apparatus, and method for using such an apparatus, for managing coolant charge in air conditioning systems operating with a heat recovery mode.

In accordance with the present invention, an apparatus for managing refrigerant charge in an air conditioning unit comprises a cooling circuit through which a refrigerant flows from a compressor, through a condenser, and through an evaporator, a heat recovery circuit extending from a first terminus between the compressor and the condenser to a second terminus between the evaporator and the condenser, a heat recovery unit located between the first and second terminus of the heat recovery circuit, a first valve located between the condenser and the first terminus, a second valve located between the first terminus and the heat recovery unit, a third valve located on a cooling charge circuit having a first end on the cooling circuit between the condenser and the evaporator and a second end at the evaporator, a fourth valve located on a heating charge circuit having a first end on the heat recovery circuit and a second end at the evaporator, and a logic unit for sensing a saturated temperature and opening and closing the valves based upon the saturated temperature to manage the refrigerant charge.

In accordance with the present invention, a method for managing refrigerant charge in an air conditioning unit comprises the steps of providing an air conditioning system comprising a cooling circuit through which a refrigerant flows from a compressor, through a condenser, and through an evaporator, a heat recovery circuit extending from a first terminus between the compressor and the condenser to a second terminus between the evaporator and the condenser, a heat recovery unit located between the first and second terminus of the heat recovery circuit, a first valve located between the condenser and the first terminus, a second valve located between the first terminus and the heat recovery unit, a third valve located on a cooling charge circuit having a first end on the cooling circuit between the condenser and the evaporator and a second end at the evaporator, a fourth valve located on a heat charge circuit having a first end on the heating recovery circuit and a second end at the evaporator, and a logic unit for sensing a saturated temperature, and utilizing the logic unit to open and close the valves to manage the refrigerant charge.

In accordance with the present invention, an apparatus for managing refrigerant charge in an air conditioning unit comprises a cooling circuit through which a refrigerant flows from a compressor, through a condenser, and through an evaporator, a heat recovery circuit extending from a first terminus between the compressor and the condenser to a second terminus between the evaporator and the condenser, a plurality of refrigerant control devices for regulating the flow of refrigerant through the cooling circuit, the heat recovery circuit, a cooling charge circuit, and a heating charge circuit, and a logic unit for sensing a saturated temperature and controlling the refrigerant control devices based upon the saturated temperature to manage the refrigerant charge.

In accordance with the present invention, a method for managing refrigerant charge in an air conditioning unit comprises the steps of providing an air conditioning system comprising a cooling circuit through which a refrigerant flows from a compressor, through a condenser, and through an evaporator, a heat recovery circuit extending from a first terminus between the compressor and the condenser to a second terminus between the evaporator and the condenser, a plurality of refrigerant control devices for regulating the flow of refrigerant through the cooling circuit, the heat recovery circuit, a cooling charge circuit, and a heating charge circuit, and a logic unit for sensing a saturated temperature and controlling the refrigerant control devices based upon the saturated temperature to manage the refrigerant charge, and utilizing the logic unit to control the plurality of refrigerant control devices so as to manage the refrigerant charge.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
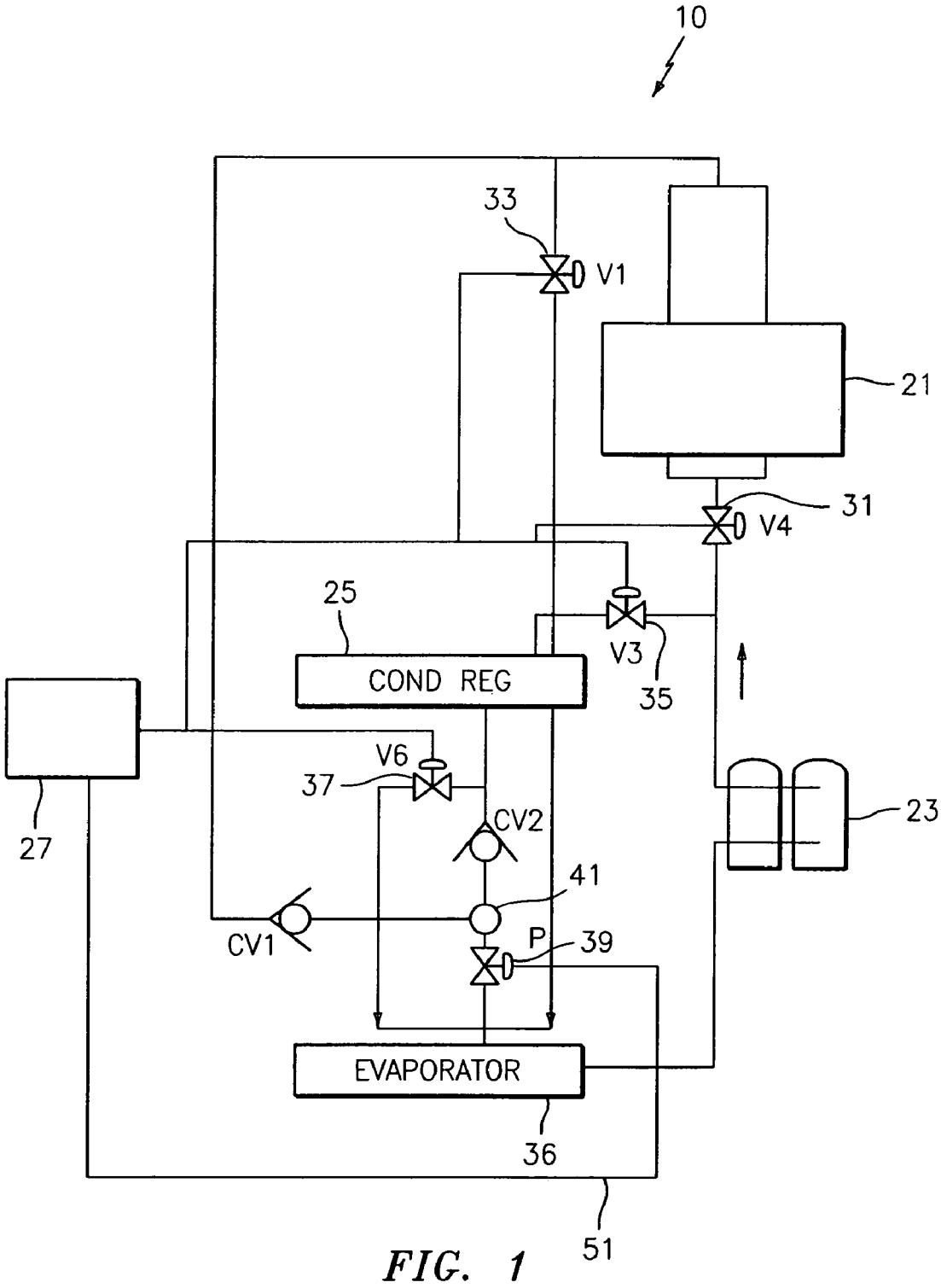
FIG. 1 is a diagram of the air conditioning system of the present invention.

It is therefore a teaching of the present invention to provide an air conditioning apparatus, and method for using such an apparatus, wherein a series of valves are added, the operation of which serves to optimize the refrigerant charge in the system in both cooling mode and heat recovery mode.

With reference to FIG. 1, there is illustrated a diagram of the apparatus of the present invention. Air conditioning unit 10 is formed of a cooling circuit. The cooling circuit is formed of a compressor or compressors 23 situated in series with condenser coils 21 and evaporator 36. During cooling mode, refrigerant is pumped from compressor 23 through condenser coils 21 around and through the evaporator 36 and back to compressors 23. Situated in parallel with the cooling circuit is a heat recovery circuit. The heat recovery circuit contains a heat recovery unit. Heat recovery circuit has a first end, or terminus, attached between compressor 23 and condenser coils 21 with the other end attached to the cooling circuit at a point between condenser coils 21 and the evaporator 36. In the embodiment shown, the second end of the heat recovery circuit is attached to the cooling circuit at a sensor node 41. As will be described more fully below, at sensor node 41 the air conditioning unit 10 of the present invention senses the pressure and temperature of the refrigerant just prior to flowing into evaporator 36.

In a preferred embodiment, the present invention makes use of the positioning of at least four valves whose positions are selected as described more fully below to enable the operation of the air conditioning unit in accordance with the method of the present invention. While described with reference to four valves, the present invention is not so-limited. Rather, the present invention encompasses any number of valves, or refrigerant flow control devices, arranged and operated so as to affect the flow of refrigerant as described below. A first valve is located between the condenser coils 21 and the first terminus of the heat recovery circuit. A second valve is located between the first terminus of the heat recovery circuit and the heat recovery unit 25. As a result of the placement of the first and second valves, 31, 35, respectively, the air conditioning unit 10 of the present invention may be operated in either cooling mode or heat recovery mode. In cooling mode, the second valve 35 is closed while the first valve 31 is opened. As a result of this configuration, refrigerant is free to flow and circulate about the cooling circuit. Conversely, in heat recovery mode, the second valve is open and the first valve is closed. In such a configuration, refrigerant circulates from the compressor 23 through the heat recovery unit 25 and on to evaporator 36 before returning to the compressors 23.

In addition to the two valves 31, 35, mentioned, there is additionally provided two more valves 33, 37. The third valve 33, is situated so as to form a cooling charge circuit having a first end located on the cooling circuit between the condenser coils 21 and the sensor node 41, and extending down to a second end terminating near the evaporator 36 such that refrigerant may flow into evaporator 36. Similarly, a fourth valve 37 is located on a heating charge circuit having a first end on the heat recovery circuit between the heat recovery unit 25 and the sensor node 41 and a second end terminating at or near the evaporator such that refrigerant may flow into the evaporator 36.

Lastly, there is provided a logic unit 27 to which is connected a sensory line 51. Sensory line 51 transmits pressure and temperature data measured at sensor node 41 to logic unit 27. Based upon the pressure and temperature measurements provided to logic unit 27 via sensory line 51, logic unit 27 controls the opening and closing of the first, second, third, and fourth valves 31, 35, 33, 37 as described below. As noted, pressure and temperature measurements are taken at sensor node 41. From these measurements, the saturated temperature is calculated. Specifically, the saturated temperature is calculated as equal to the liquid pressure leaving the condenser minus the actual refrigerant temperature leaving the condenser. The saturated temperature is compared to a subcooling set point for the air conditioning system 10 of the present invention.

As noted above, when in the cooling mode, second valve 35 is turned off and the first valve 31 is opened to allow refrigerant to circulate throughout the cooling circuit. If the logic unit determines that the calculated saturated temperature is below the subcooling set point, the fourth valve 37 is opened. As a result of opening the fourth valve 37, heat charge stored in the heat recovery unit then flows into the cooling circuit via the entry point of heating charge circuit in proximity to evaporator 36. This infusion of additional heat charge works to increase the calculated saturated temperature. The calculated saturated temperature is allowed to rise until approximately equaling the desired subcooling set point, at which time, the fourth valve 37 is once again closed. Conversely, if the calculated saturated temperature is in excess of the desired subcooling set point, the second valve 35 is opened. As a result, a portion of the charge contained in the refrigerant circulating through the cooling circuit, is siphoned off and into heat recovery unit 25. The second valve 35 remains open until a sufficient amount of heat has been recovered such that the calculated saturated temperature falls back to a point approximately equaling the subcooling set point.

As noted above, in heat recovery mode, the second valve 35 is opened while the first valve 31 is closed. Once again, the saturated temperature is calculated by logic unit 27 from measurements of the pressure and temperature sensor mode 41. In the instance that the computed saturated temperature is below the desired subcooling set point, the third valve 33 is opened to recover charge stored in the condenser coils. Third valve 33 remains open until a sufficient amount of charge has been recovered to raise the calculated saturated temperature to a temperature approximately equal to that of the subcooling set point. Conversely, in the instance that logic unit 27 computes the saturated temperature to be in excess of the subcooling set point, the first valve 31 is opened so as to store charge in the condenser coils 21 until a calculated saturated temperature diminishes to a temperature approximately equal to the subcooling set point.

Logic unit 27 may be any computational device, either analog or digital, capable of receiving input data, such as pressure and temperature data and calculating the saturated temperature therefrom. Logic unit 27 is additionally of a construction capable of issuing output signals so as to direct the opening and closing of the first, second, third, and fourth valves 31, 35, 33, 37.

One or more embodiments of the present invention have been described. Nevertheless, it will be understood that various modifications may be made without departing from the spirit and scope of the invention. Accordingly, other embodiments are within the scope of the following claims.

What is claimed is:

1. An apparatus for managing refrigerant charge in an air conditioning unit comprising:

a cooling circuit through which a refrigerant flows from a compressor, through a condenser, and through an evaporator;

a heat recovery circuit extending from a first terminus between said compressor and said condenser to a second terminus between said evaporator and said condenser;

a heat recovery unit located between said first and second terminus of said heat recovery circuit;

a first valve located between said condenser and said first terminus;

a second valve located between said first terminus and said heat recovery unit;

a third valve located on a cooling charge circuit having a first end on said cooling circuit between said condenser and said evaporator and a second end at said evaporator;

a fourth valve located on a heating charge circuit having a first end on said heat recovery circuit and a second end at said evaporator; and a logic unit for sensing a saturated temperature and opening and closing said valves based upon said saturated temperature to manage said refrigerant charge.

2. A method for managing refrigerant charge in an air conditioning unit comprising the steps of:

providing an air conditioning system comprising:

a cooling circuit through which a refrigerant flows from a compressor, through a condenser, and through an evaporator;

a heat recovery circuit extending from a first terminus between said compressor and said condenser to a second terminus between said evaporator and said condenser;

a heat recovery unit located between said first and second terminus of said heat recovery circuit;

a first valve located between said condenser and said first terminus;

a second valve located between said first terminus and said heat recovery unit;

a third valve located on a cooling charge circuit having a first end on said cooling circuit between said condenser and said evaporator and a second end at said evaporator;

a fourth valve located on a heat charge circuit having a first end on said heating recovery circuit and a second end at said evaporator; and a logic unit for sensing a saturated temperature; and utilizing said logic unit to open and close said valves to manage said refrigerant charge.

3. The method of claim 2 wherein said opening and closing said valves comprises the additional steps of:

enabling a cooling mode;

opening said fourth valve when a saturated temperature is below a subcooling set point; and opening said second valve when a saturated temperature is above a subcooling set point.

4. The method of claim 3 wherein said enabling said cooling mode comprises opening said first valve and closing said second valve.

5. The method of claim 2 wherein said opening and closing comprises the additional steps of:

enabling a heat recovery mode;

opening said third valve when a saturated temperature is below a subcooling set point; and opening said first valve when a saturated temperature is above a subcooling set point.

6. The method of claim 5 wherein said enabling said heat recovery mode comprises opening said second valve and closing said first valve.

7. An apparatus for managing refrigerant charge in an air conditioning unit comprising:

a cooling circuit through which a refrigerant flows from a compressor, through a condenser, and through an evaporator;

a heat recovery circuit extending from a first terminus between said compressor and said condenser to a second terminus between said evaporator and said condenser;

a plurality of refrigerant control devices for regulating the flow of refrigerant through said cooling circuit, said heat recovery circuit, a cooling charge circuit, and a heating charge circuit; and a logic unit for sensing a saturated temperature and controlling said refrigerant control devices based upon said saturated temperature to manage said refrigerant charge.

8. The apparatus of claim 7 additionally comprising a heat recovery unit located on said heat recovery circuit.

9. The apparatus of claim 7 wherein said plurality of refrigerant control devices comprises a plurality of valves.

10. A method for managing refrigerant charge in an air conditioning unit comprising the steps of:

providing an air conditioning system comprising:

a cooling circuit through which a refrigerant flows from a compressor, through a condenser, and through an evaporator;

a heat recovery circuit extending from a first terminus between said compressor and said condenser to a second terminus between said evaporator and said condenser;

a plurality of refrigerant control devices for regulating the flow of refrigerant through said cooling circuit, said heat recovery circuit, a cooling charge circuit, and a heating charge circuit; and a logic unit for sensing a saturated temperature and controlling said refrigerant control devices based upon said saturated temperature to manage said refrigerant charge; and utilizing said logic unit to control said plurality of refrigerant control devices so as to manage said refrigerant charge.

11. The method of claim 10 wherein said utilizing said logic unit to control said plurality of refrigerant control devices comprises the additional steps of:

enabling a cooling mode;

operating one of said plurality of refrigerant control devices to enable a refrigerant flow through said heat charge circuit when a saturated temperature is below a subcooling set point; and operating one of said plurality of refrigerant control devices to enable a refrigerant flow through said heat recovery circuit when a saturated temperature is above a subcooling set point.

12. The method of claim 10 wherein said opening and closing comprises the additional steps of:

enabling a heat recovery mode;

operating one of said plurality of refrigerant control devices to enable a refrigerant flow through said cooling charge circuit when a saturated temperature is below a subcooling set point; and operating one of said plurality of refrigerant control devices to enable a refrigerant flow through said cooling circuit when a saturated temperature is above a subcooling set point.

* * * * *